US009745771B2

(12) United States Patent
Campbell

(10) Patent No.: US 9,745,771 B2
(45) Date of Patent: Aug. 29, 2017

(54) POLE ERECTION APPARATUS AND METHOD

(71) Applicant: CPD Powerline Ltd, Loughgall, County Armagh (GB)

(72) Inventor: Colm Campbell, Loughgall (GB)

( * ) Notice: Subject to any disclaimer, the term of this patent is extended or adjusted under 35 U.S.C. 154(b) by 0 days.

(21) Appl. No.: 14/839,076

(22) Filed: Aug. 28, 2015

(65) Prior Publication Data

US 2016/0060894 A1 Mar. 3, 2016

(30) Foreign Application Priority Data

Aug. 29, 2014 (GB) ..... 1415288.8

(51) Int. Cl.
*E04H 12/34* (2006.01)

(52) U.S. Cl.
CPC ..... *E04H 12/347* (2013.01); *E04H 12/34* (2013.01); *E04H 12/345* (2013.01)

(58) Field of Classification Search
CPC ..... E04H 12/347; E04H 12/34; E04H 12/345
USPC ..... 52/122.1, 123.1; 414/23
See application file for complete search history.

(56) References Cited

U.S. PATENT DOCUMENTS 3,112,830 A * 12/1963 Podlesak ..... B66C 13/18 294/106
3,628,675 A * 12/1971 Balogh ..... A01G 17/16 212/231
4,033,080 A * 7/1977 Fukushima ..... E04H 12/02 29/402.12
4,492,496 A * 1/1985 Arnold ..... B27C 5/08 405/250
5,794,387 A * 8/1998 Crookham ..... F21V 21/36 52/122.1
5,899,651 A * 5/1999 Jenvey ..... 414/23
5,924,832 A * 7/1999 Rice ..... E04H 12/34 135/908
6,709,215 B1 3/2004 Sorensen
2008/0127872 A1* 6/2008 Hall ..... F21V 21/36 114/91
2009/0245994 A1 10/2009 Ritola

FOREIGN PATENT DOCUMENTS

GB 2425296 A 10/2006

OTHER PUBLICATIONS

UK Search Report, dated Dec. 22, 2014, for UK patent application GB 1415288.8, filed on Aug. 29, 2014.

* cited by examiner

*Primary Examiner* — Paola Agudelo
(74) *Attorney, Agent, or Firm* — Warner Norcross & Judd LLP

(57) ABSTRACT

A pole erection apparatus comprising a guide portion for receiving a pole longitudinally; a support portion that is pivotable with respect to the guide portion and which receives the pole and supports it pole longitudinally; and actuator for pivoting the support portion with respect to the guide portion between a relatively reclined state and a relatively upright state. In the relatively upright state, the respective bodies of the guide portion and the support portion are aligned with one another to allow the pole to slide longitudinally from the support portion into the guide portion.

14 Claims, 4 Drawing Sheets

POLE ERECTION APPARATUS AND METHOD

FIELD OF THE INVENTION

The present invention relates to the erection and de-erection of poles such as electricity poles, telegraph poles and street lamp poles.

BACKGROUND TO THE INVENTION

Conventionally electricity, telegraph and street lamp poles are erected and de-erected using a combination of bogies, cranes and manual labour. The required equipment can make erection difficult or impossible in confined spaces, e.g. in gardens, compounds, forests or crop fields. Also, the pole can be relatively unstable during erection or de-erection, which endangers workers. Moreover, conventional erection and de-erection processes are considered to be relatively labour intensive and therefore expensive.

It would be desirable to provide an improved pole erection apparatus and method.

SUMMARY OF THE INVENTION

A first aspect of the invention provides a pole erection apparatus comprising:

a guide portion comprising a body shaped and dimensioned to receive a pole longitudinally;

a support portion being pivotable with respect to the guide portion and comprising a body shaped and dimensioned to receive the pole and to support the pole in a direction along its longitudinal axis;

at least one actuator coupled to the support portion and operable to pivot the support portion with respect to the guide portion between a relatively reclined state and a relatively upright state, wherein, in the relatively upright state, the respective bodies of the guide portion and the support portion are aligned with one another to allow the pole to slide longitudinally from the support portion into the guide portion.

A second aspect of the invention provides a method of erecting a pole using an apparatus as claimed in any preceding claim, the method comprising:

installing said guide portion in a hole formed in the ground in a substantially vertical orientation with an open mouth of said guide body portion exposed for receiving a pole longitudinally;

with said support portion in said relatively reclined state, locating said pole in said support portion; and operating said at least one actuator to move said support portion to said relatively upright state to cause said pole to slide into said guide portion.

Further advantageous aspects of the invention will be apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which.

DETAILED DESCRIPTION OF THE DRAWINGS

Figure 1:
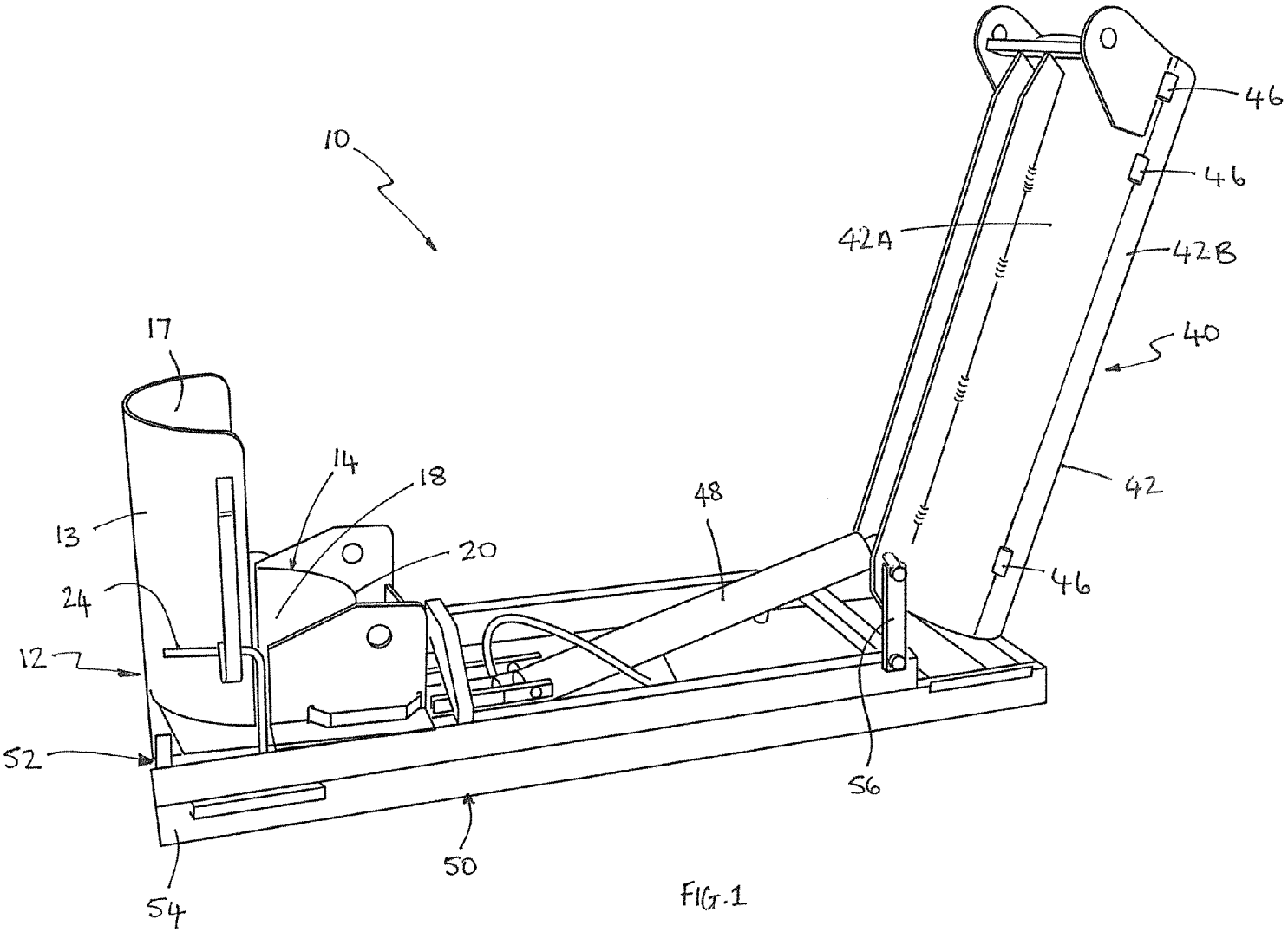
FIG. 1 is a perspective view of a pole erection apparatus embodying one aspect of the invention.
Figure 2:
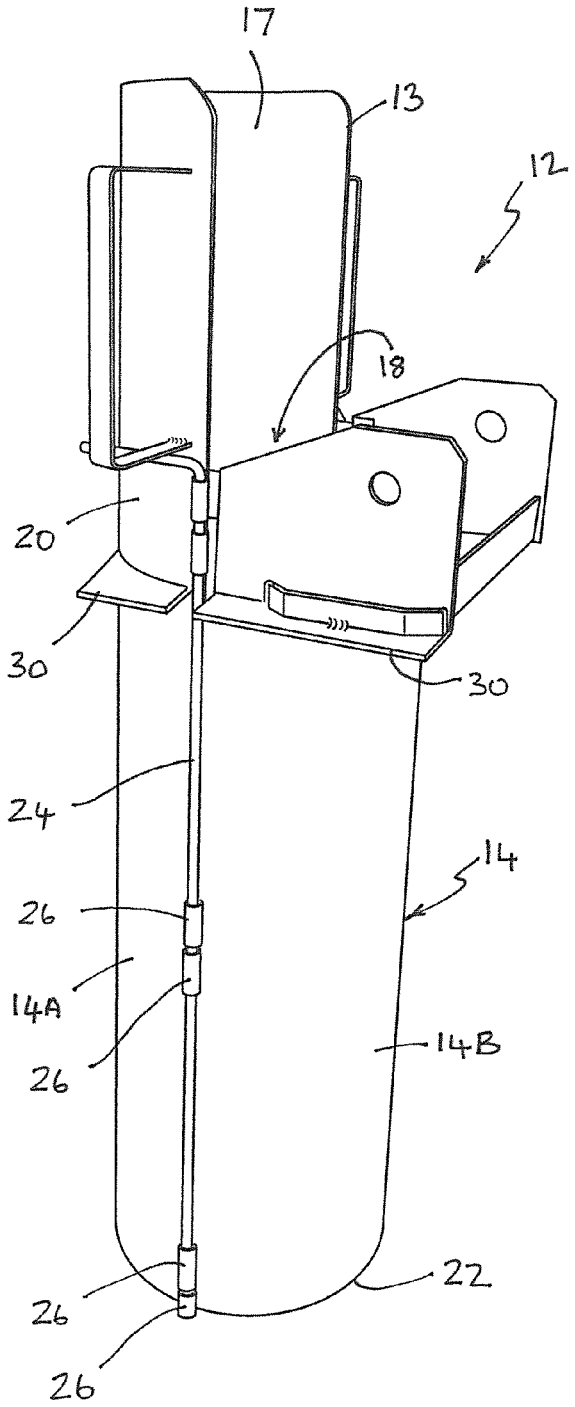
FIG. 2 is a perspective view of a guide portion of the apparatus of FIG. 1.
Figure 3:
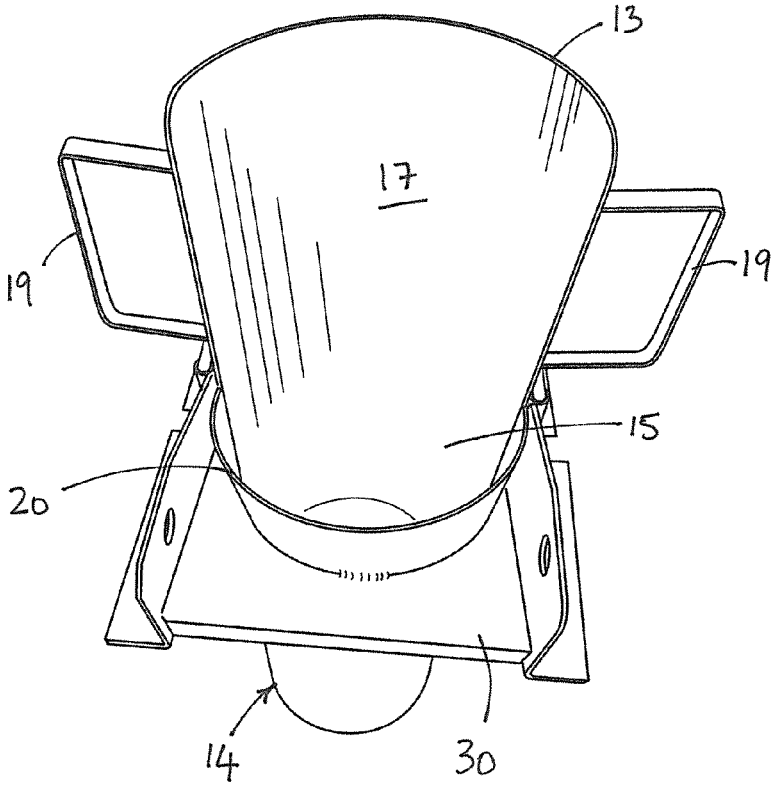
FIG. 3 is an alternative perspective view of the guide portion of FIG. 2.

Referring now to the drawings there is shown, generally indicated as 10, a pole erection apparatus embodying the invention. The apparatus 10 comprises a guide portion 12 which comprises a body 14 that is shaped and dimensioned to receive a pole 16 longitudinally. In particular, the body 14 has an open mouth 18 formed at one end 20 that is capable of receiving the pole 16, end first, such that the respective longitudinal axes of the pole 16 and of the body 14 are substantially co-incident or at least substantially parallel. In the preferred embodiment, the body 14 is sleeve-like in shape and is open and both ends 20, 22.

The preferred body 14 comprises first and second parts 14A, 14B operable between a closed state (as illustrated) in which they surround the pole 16 about its longitudinal axis, and an open state (not illustrated) in which the pole 16 is removable from the body 14 in a lateral direction. In the illustrated embodiment, the first and second body parts 14A, 14B are each substantially semi-cylindrical in shape. The body parts 14A, 14B may take other shapes, for example one or other of the body parts 14A, 14B may comprise one or more straps, bands or other retaining member (not illustrated). Typically however, each body part 14A, 14B has an internal surface (e.g. surface 15 in the illustrated embodiment) that is concave, e.g. U-shaped or substantially semi-circular, in cross-section so that, in the closed state, the respective body part 14A, 14B partially surrounds the pole 16 when present. In alternative embodiments (not illustrated), the body 14 does not surround the pole 16, instead it partially surrounds the pole 16, preferably surrounding at least half of the circumference of the pole 16 when present. In embodiments where the body 14 surrounds more than half of the circumference of the pole 16 it is preferably formed from at least two parts (e.g. parts 14A, 14B) to allow it to be opened to be removed from the pole 16 as is described in more detail below. Alternatively, the body 14 may comprise a single part, e.g. body part 14A, in which case it is preferred that the body 14 does not extend more than halfway around the circumference of the pole when present. It will be apparent that the mouth 18 may or may not be annular depending on the shape of the body 14.

In the preferred embodiment, the body 14 has a length that is at least as long as the depth of a hole 28 into which the pole is to be installed. Alternatively, the body 14 may be shorter than the hole depth. In either case, it is preferred that the body 14 includes a collar 30 adjacent end 20 which extends laterally outwardly of the body 14. The collar 30 may extend around all or part of the external periphery of the body 14. The collar 30 is shaped and dimensioned to engage with the ground surface 32 around the hole 60 and so to position the guide portion 12 with respect to the hole 60, in particular such that the end 20 is located adjacent the ground surface 32. Alternatively, any other suitable laterally projecting locating structure (e.g. pins or flanges) may be provided for this purpose.

The body parts 14A, 14B may be detachable from one another, or may be hinged together along a longitudinally oriented hinge axis. Retaining means are provided to releasably retain the body parts 14A, 14B in the closed state. In the illustrated embodiment, the retaining means comprises a pin 24 that is insertable into at least one sleeve 26 provided in each of the body parts 14A, 14B, the respective sleeve(s) of each part 14A, 14B aligning longitudinally with one another in the closed state to allow the pin 24 to be inserted or removed. Typically, a respective pin 24 and socket 26 retaining is provided at opposite sides of the body 14. With one pin 24 inserted and the other removed, 25 the inserted pin 24 and respective sockets 26 may act as a hinge about which the body 14 can be opened. Alternatively, both pins 24 can be removed to allow the body parts 14A, 14B to be detached.

The apparatus 10 further includes a support portion 40 that is pivotable with respect to the guide portion 12. The support portion 40 is typically pivotably coupled to the guide portion 12, preferably by means of a detachable pivot coupling 41. Accordingly, and as can be seen from FIG. 1, the support portion 40 and guide portion 12 can be decoupled from one another. Not only does this facilitate transport and storage of the apparatus 10, but it also facilitates transport of poles as is described in more detail hereinafter.

The support portion 40 comprises a body 42 shaped and dimensioned to receive the pole 16 and to support the pole in a direction along its longitudinal axis. FIG. 1 shows the preferred body 42 comprising first and second parts 42A, 42B operable between a closed state (as illustrated) in which they surround the pole 16 about its longitudinal axis, and an open state (not illustrated) in which the pole 16 is removable from the body 42 in a lateral direction. In the illustrated embodiment, the first and second body parts 42A, 42B are each substantially semi-cylindrical in shape. The body parts 42A, 42B may take other shapes, for example one or other of the body parts 42A, 42B may comprise one or more straps, bands or other retaining member (see FIGS. 4A and 4B where the body part 42B comprises longitudinally spaced-apart bands). Typically however, each body part 42A, 42B has an internal surface that is concave, e.g. U-shaped or substantially semi-circular, in cross-section so that, in the closed state, the respective body part 42A, 42B partially surrounds the pole 16 when present. In alternative embodiments (not illustrated), the body 42 does not surround the pole 16, instead it partially surrounds the pole 16, preferably surrounding at least half of the circumference of the pole 16 when present. In embodiments where the body 42 surrounds more than half of the circumference of the pole 16 it is preferably formed from at least two parts (e.g. parts 42A, 42B) to allow it to be opened to be removed from the pole 16 as is described in more detail below. Alternatively, the body 42 may comprise a single part, e.g. body part 42A, in which case it is preferred that the body 42 does not extend more than halfway around the circumference of the pole when present, although retaining means such as strap(s) or band(s) are preferably provided to retain the pole 16 in the support 42.

The preferred body 42 is sleeve-like in shape and is open and both ends. The preferred arrangement is such that the respective longitudinal axes of the pole 16 and of the body 42 are substantially co-incident or at least substantially parallel. Loading or unloading of the pole 16 may be performed laterally, e.g. with the body parts 42A, 42B open, or longitudinally, i.e. through an open end of the body 42 as is convenient.

The body parts 42A, 42B may be detachable from one another, or may be hinged together along a longitudinally oriented hinge axis. Retaining means are provided to releasably retain the body parts 42A, 42B in the closed state. In the illustrated embodiment, the retaining means comprises a pin (not shown) that is insertable into at least one sleeve 46 provided in each of the body parts 42A, 42B, the respective sleeve(s) of each part 42A, 42B aligning longitudinally with one another in the closed state to allow the pin to be inserted or removed. Typically, a respective pin and socket 46 retaining device is provided at opposite sides of the body 42. With one pin inserted and the other removed, the inserted pin and respective sockets 46 may act as a hinge about which the body 42 can be opened. Alternatively, both pins can be removed to allow the body parts 42A, 42B to be detached.

In the preferred embodiment, the guide portion body 12 includes a stop member 13 extending in use upwardly from a rear side of the mouth 18, i.e. the side opposite the support portion 40 when the support portion 40 is coupled to the guide portion 12. The stop member 13 preferably has an inner surface 17 with a concave transverse cross-sectional shape. For example, the stop member 13 may comprise a plate with a substantially semi-circular or curved transverse cross-section.

The apparatus 10 further comprises an actuator 48, preferably a linear actuator such as a ram. In the preferred embodiment the actuator 48 is a hydraulic ram. In alternative embodiments, more than one actuator may be provided. The actuator 48 has one end coupled to the support portion 40 and operable to pivot the support portion 40 with respect to the guide portion 12 between a relatively reclined state (FIG. 4A) and a relatively upright state (FIG. 4B). In the relatively upright state, the respective bodies 14, 42 of the guide portion 12 and the support portion 40 are aligned with one another to allow the pole 16 to slide longitudinally from the support portion 40 (which has an open end for this purpose) into the guide portion 12 via mouth 18 (FIG. 4B). In preferred embodiments, the longitudinal axis of the support portion 40 (and of the pole 16 when present) is substantially vertical in the relatively upright state, and may be substantially horizontal in the relatively reclined state.

In preferred embodiments, the apparatus 10 includes a base 50, for example in the form of a frame. The actuator 48 is coupled between the base 50 and the support portion 40, typically such that one end is pivotably coupled to the base 50, and the other end is pivotably coupled to the support portion 40.

In preferred embodiments, the base 50 includes means for releasably engaging with the guide portion 12, preferably such that the base 50 and the guide portion 12 become (releasably) mechanically coupled with one another. In the illustrated embodiment the base 50 is shaped to define a seat 52 for receiving and engaging with the guide portion 12. For example, the seat 52 may comprise a pair of spaced-apart arms 54 (only one visible) projecting from the base 50, between which the guide portion 12 can be received. The seat 52 may for example engage with the collar 30. The preferred arrangement is such that, when the support portion 40 is coupled to the guide portion 12, the guide portion 12 is received in the seat 52.

The base 50 may include a stand 56 on which the support portion 40 may rest in the relatively reclined state.

Figure 4A:
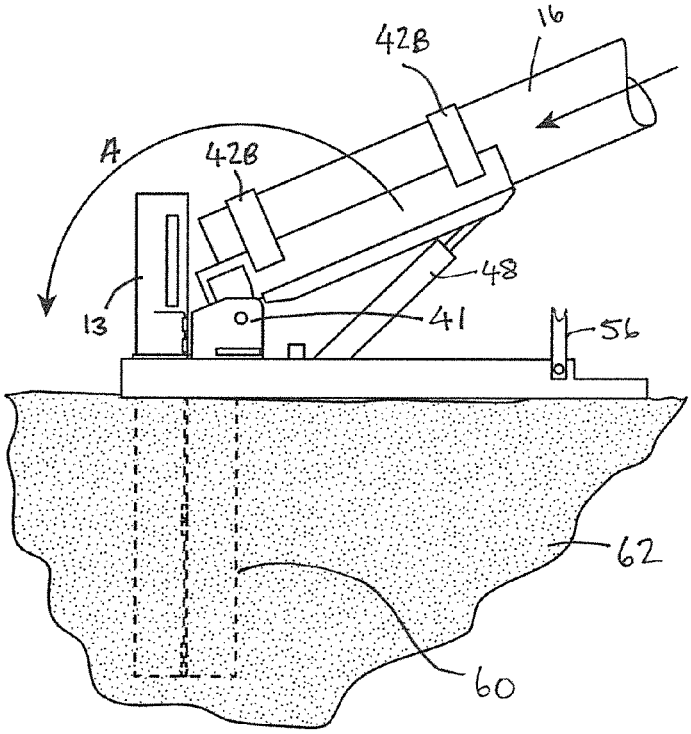
FIGS. 4A and 4B are respective side views of the apparatus of FIG. 1 during respective stages of erecting a pole.
Figure 4B:
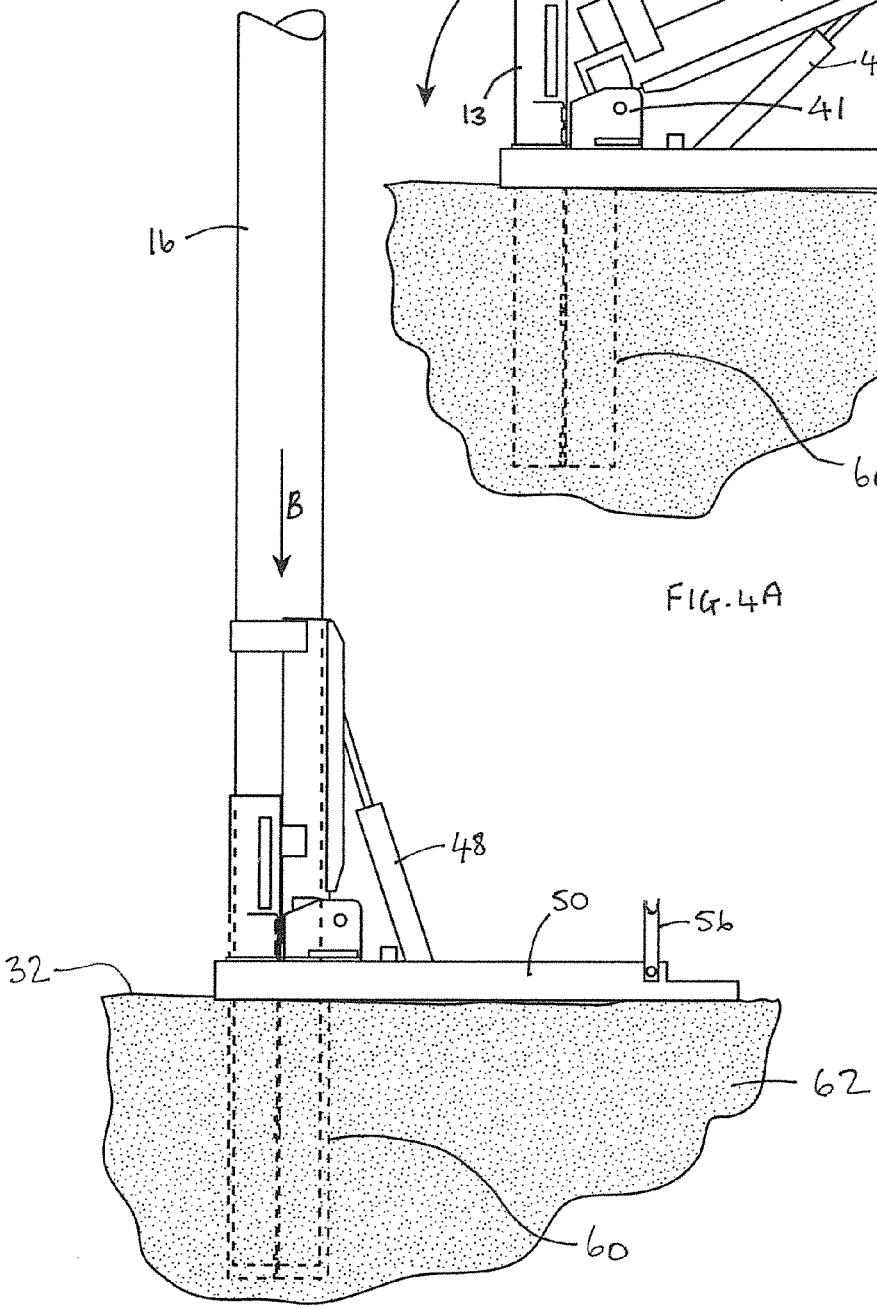

Use of the apparatus 10 in the erection of the pole 16 in a hole 60 formed in the ground 62 is now described with particular reference to FIGS. 4A and 4B. The guide portion 12 is inserted into the hole 60 such that the end 20 with mouth 18 is exposed, typically such that the mouth is located substantially at the mouth of the hole 60. The arrangement is such that the stop member 13 projects upwardly out of the hole 60.

The pole 16 is installed in the support portion 40 typically such that the body 42 is located at, and preferably around, the in-use lower end of the pole 16, i.e. the portion of the pole 16 that is to be inserted into the hole 60. Conveniently, this installation is performed with the support portion 40 in its relatively reclined state. The body 42 may be opened to allow the pole 16 to be installed from a lateral direction, or the pole 16 may be inserted through an open end of the body 42, as convenient. Optionally, installation of the pole 16 in the support portion 40 may be performed with the support portion 40 decoupled from the guide portion 12, and with the base 50 dis-engaged from the guide portion 12. This allows the installation of the pole 16 in the support portion 40 to be performed remotely from the guide portion 12/hole 60. In such cases, the assembly of the base 50 and support portion 40 may be conveyed to the guide portion 12/hole 60 on a vehicle (not shown), for example a bogie or trolley. Alternatively, the base 50 may be provided with one or more runners, wheels, rollers and/or tracks (not shown) for this purpose.

When the support portion 40 is coupled to the guide portion 12 and the pole 16 is installed in the support portion 40, the actuator 48 is operated to pivot the support portion 40 into the relatively upright state, as indicated by arrow A in FIG. 4A. As the support portion 40 approaches the relatively upright state, the pole 16 tends to slide out of the body 42 in a longitudinal direction under the influence of gravity. In the preferred embodiment, such movement of the pole 16 is permitted by the open end of the body 42 and lack of any restraint device for impeding such movement of the pole 16. In alternative embodiments, a releasable restraining device (not shown), e.g. comprising one or more releasable straps, clamps and or stops, may be provided for preventing sliding movement of the pole 16. The restraining device may be operated to release the pole 16 at an appropriate moment in the erection process, e.g. when the support portion 40 reaches the relatively upright state. In either case, when the pole 16 slides out of the body 42, its end engages with the stop member 13, which halts the sliding movement and prevents the end of the pole 16 from over-shooting the mouth 18. It will be understood that in embodiments where the pole 16 is not released from the support 40 until the body 42 is in the relatively upright state, the pole 16 may not engage with the stop member 13 as it may be aligned with the mouth 18.

When the relatively upright state is reached, the pole 16 slides through the mouth 18, with or without the guidance of the stop member 13, into the guide portion 12 under the influence of gravity (arrow B in FIG. 4B). The guide portion 12, in particular its body 14, guides the pole 16 into the hole 60.

After erection of the pole 16, the support portion 40 is operated into its open state to allow it to be removed from the pole 16 laterally. The support portion 40 and base 50 may then be removed from the site. The guide portion 12 may lifted out of the hole 60 by sliding it up the pole 16 (handles 19 may be provided for this purpose), and operated into its open state to allow it to be removed from the pole 16 laterally. It will be apparent that the support portion 40 and/or the guide portion 12 may be removed from the pole by sliding it longitudinally off the end of the pole 16, although this is considered to be inconvenient.

To de-erect the pole 16, the guide portion 12 may be fitted to an exposed portion of the pole 16 and slid down into the hole 60. With the base 50 appropriately positioned with respect to the guide portion 12, the support portion 40 is coupled to the guide portion 12 in its relatively upright state and fitted around the pole 16. The pole 16 may then be lifted out of the hole 60, e.g. using a crane (not shown), and once the pole 16 is clear of the mouth 18 the support portion 40 is operated into the relatively reclined state.

The invention is not limited to the embodiment(s) described herein but can be amended or modified without departing from the scope of the present invention.

The invention claimed is:

1. A pole erection apparatus comprising:

a guide portion comprising a body shaped and dimensioned to receive a pole longitudinally;

a support portion being pivotable with respect to the guide portion and comprising a body shaped and dimensioned to receive the pole and to support the pole in a direction along its longitudinal axis;

at least one actuator coupled to the support portion and operable to pivot the support portion with respect to the guide portion between a relatively reclined state and a relatively upright state, wherein, in the relatively upright state, the respective bodies of the guide portion and the support portion are aligned with one another to allow the pole to slide longitudinally from the support portion into the guide portion, the pole erection apparatus further comprising a base and wherein said actuator is coupled between said base and said support portion, wherein said at least one actuator has one end pivotably coupled to the base, and the other end pivotably coupled to the support portion.

2. The apparatus of claim 1, wherein either one or both of the guide portion body and the support portion body is open at opposite ends to allow it to slide longitudinally along the pole.

3. The apparatus of claim 1, wherein either one or both of the guide portion body and the support portion body comprises at least one body part shaped and dimensioned to extend around at least part of the circumference of the pole.

4. The apparatus of claim 1, wherein either one or both of the guide portion body and the support portion body comprises at least two parts operable between a closed state in which they surround or partially surround the pole about the longitudinal axis, and an open state in which the pole is removable from the respective body in a lateral direction.

5. The apparatus of claim 4, wherein said at least two parts are hinged to one another about a hinge axis that runs longitudinally of the guide portion body, or are detachable from one another.

6. The apparatus of claim 4, wherein either one or both of the guide portion body and the support portion body comprises retaining means for retaining the at least two parts in the closed state.

7. The apparatus of claim 1, wherein either one or both of the guide portion body and the support portion body is sleeve-like in shape.

8. The apparatus of claim 7, wherein either one or both of the guide portion body and the support portion body comprises first and second parts each having an inner surface with a concave cross-sectional shape such that, in a closed state, the first and second parts together form said sleeve-like body.

9. The apparatus of claim 1, wherein said guide portion body comprises a mouth at an in-use upper end, and a stop member extending in use upwardly from a rear side of said mouth, said stop member having an inner surface with a concave cross-sectional shape.

10. The apparatus of claim 1, wherein said guide portion body includes a locating structure comprising a collar, extending laterally from the guide portion body adjacent an in-use upper end of the body.

11. The apparatus of claim 1, wherein said support portion is pivotably coupled to said guide portion by means of a detachable coupling.

12. The apparatus of claim 1 wherein said base includes means for releasably engaging with said guide portion.

13. A method of erecting a pole using an apparatus as claimed in claim 1, the method comprising:

installing said guide portion in a hole formed in the ground in a substantially vertical orientation with an open mouth of said guide portion body exposed for receiving a pole longitudinally;

with said support portion in said relatively reclined state, locating said pole in said support portion; and operating said at least one actuator to move said support portion to said relatively upright state to cause said pole to slide into said guide portion, the method further including removing said guide portion from said hole and from around said pole.

14. The method of claim 13, further including removing said support portion from said pole.

* * * * *